US006089914A

United States Patent [19]

Piovesan

[11] Patent Number: 6,089,914

[45] Date of Patent: Jul. 18, 2000

[54] SERIALLY ASSOCIATED ELECTRICAL CONNECTORS FOR FEEDING AUTOMATED WIRING MACHINES

[75] Inventor: Gianni Piovesan, Cadoneghe, Italy

[73] Assignee: Inarca S.p.A., Vigodarzere, Italy

[21] Appl. No.: 09/184,052

[22] Filed: Nov. 2, 1998

[30] Foreign Application Priority Data

Nov. 14, 1997 [IT] Italy ..... PD97U0081

[51] Int. Cl.[7] ..... H01R 13/40

[52] U.S. Cl. ..... 439/590; 439/937

[58] Field of Search ..... 439/590, 937, 439/752, 718, 885

[56] References Cited

U.S. PATENT DOCUMENTS

| | | | |
|---|---|---|---|
| 4,541,174 | 9/1985 | Liburdi | 29/883 |
| 4,655,517 | 4/1987 | Bryce | 439/590 |
| 4,921,440 | 5/1990 | Matsumoto | 439/421 |
| 4,973,267 | 11/1990 | Ramelet | 439/590 |
| 5,772,480 | 6/1998 | Yamamoto et al. | 439/885 |

*Primary Examiner*—Khiem Nguyen

*Assistant Examiner*—Son V. Nguyen

*Attorney, Agent, or Firm*—Guido Modiano; Albert Josif; Daniel O'Byrne

[57] ABSTRACT

A set of serially associated electrical connectors for feeding automated wiring machines, wherein the connectors are monolithically connected to each other by one or more straps which allow to form reels which can be loaded into wiring machines.

3 Claims, 2 Drawing Sheets

10

SERIALLY ASSOCIATED ELECTRICAL CONNECTORS FOR FEEDING AUTOMATED WIRING MACHINES

BACKGROUND OF THE INVENTION

The present invention relates to serially associated electrical connectors for feeding automated wiring machines.

It is known that connectors are currently increasingly used to accommodate electrical terminals to be connected to electrical connection wires.

In particular, the connection assemblies are used in wiring meant for mass-production.

Wiring machines which automatically connect electrical wires and metal terminals are commercially available for this purpose.

In order to allow wiring machines to operate adequately, the machines must be supplied with connectors and corresponding terminals as simply and effectively as possible.

Feeding individual connectors was immediately found to be inadequate for wiring machines, because of problems in solving the dynamics of feeding and because such machines require continuous feeding at a very high rate.

Packs constituted by a plurality of connectors arranged side by side in succession within elongated hollow supports have accordingly been produced.

However, this solution is not ideal owing to the rigidity of the packs and to the difficulties encountered in handling them.

In order to obviate the rigidity drawbacks of connector packs, reels have been provided which are constituted by a plurality of connectors which are connected to each other by mutual engagement.

However, also this solution is not ideal, since it entails constructive and manufacturing complications during the production of the reel because it is necessary to start from individual connectors and then produce engagement.

Moreover, the engagement among the connectors is not always reliable, since excessive play can lead to weakening of the connection among the connectors.

SUMMARY OF THE INVENTION

The aim of the present invention is to provide serially arranged connectors which solve the above-described drawbacks, in particular by combining simple and quick execution with the possibility to adequately and effectively feed wiring machines.

Within the scope of this aim, an object of the present invention is to provide serially associated connectors which are mutually connected stably and safely, regardless of machining tolerances, and can then be cut to size equally simply and quickly.

Another object of the present invention is to provide serially associated connectors whose application to the wiring operation can be automated substantially entirely.

Another object of the present invention is to provide serially associated connectors whose production is economically competitive with respect to conventional connectors that can be manufactured with equally conventional technologies.

This aim, these objects and others which will become apparent hereinafter are achieved by a set of serially associated electrical connectors for feeding automated wiring machines, characterized in that said connectors are monolithically connected to each other by one or more flexible straps which allow to form reels which can be loaded into wiring machines.

BRIEF DESCRIPTION OF THE DRAWINGS

Further characteristics and advantages of the present invention will become apparent from the following detailed description of an embodiment thereof, illustrated only by way of non-limitative example in the accompanying drawings, wherein.

DESCRIPTION OF THE PREFERRED EMBODIMENTS

Figure 3:
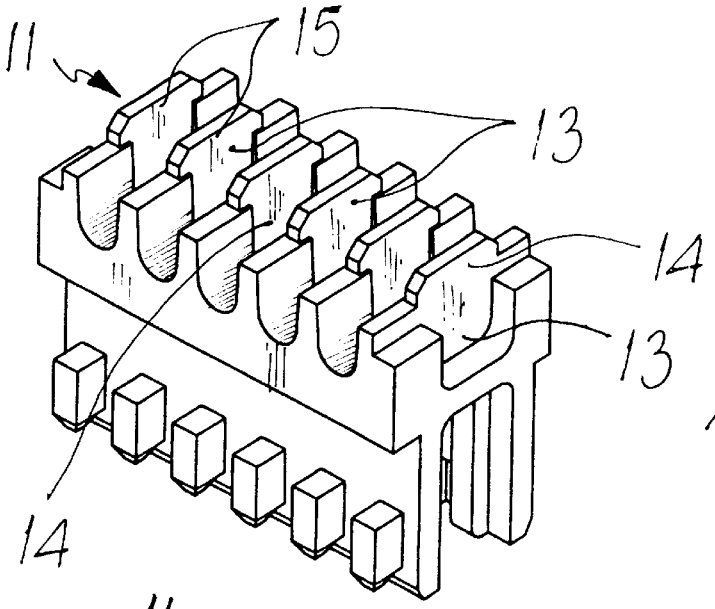
FIG. 3 is a perspective view of a connector of the series of FIG. 1.
Figure 1:
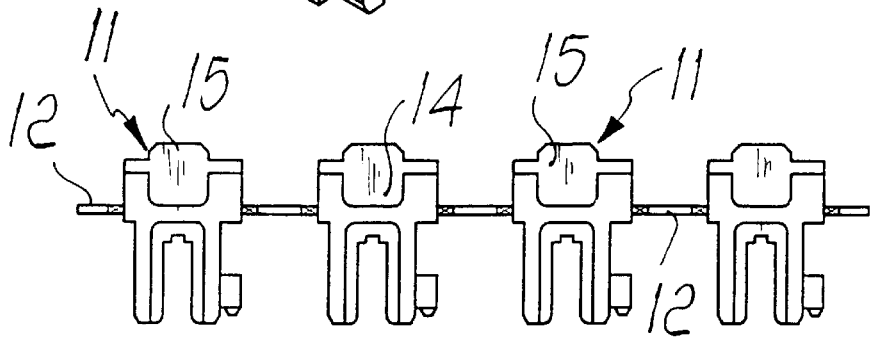
FIG. 1 is a side view of serially associated connectors according to the invention.
Figure 2:
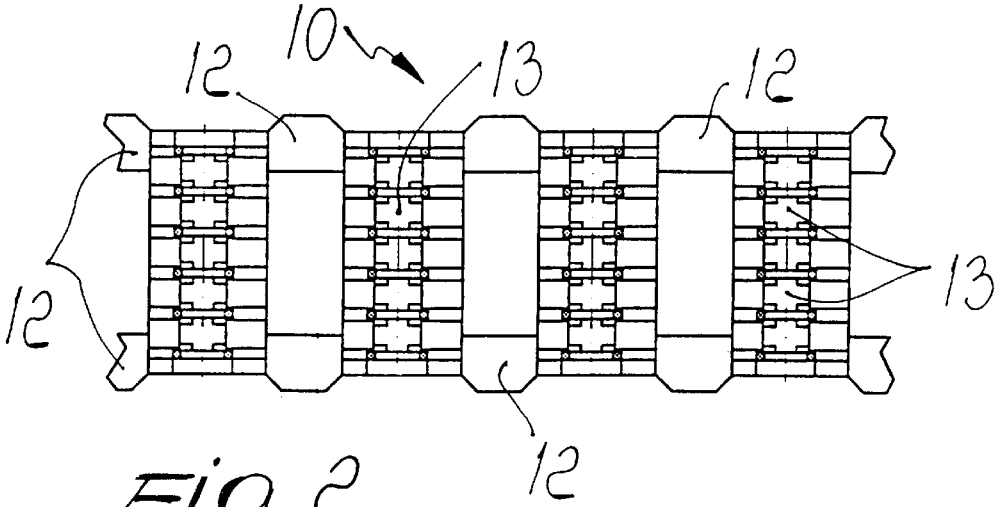
FIG. 2 is a plan view of the serially associated connectors of FIG. 1.
Figure 4:
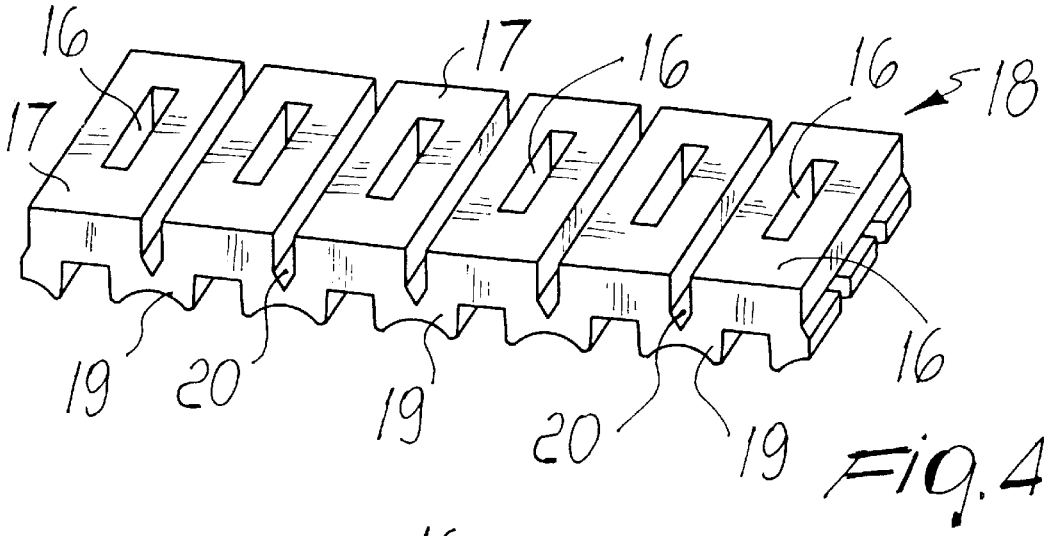
FIG. 4 is a perspective view of a plurality of covers for the connectors of FIG. 1.
Figure 5:
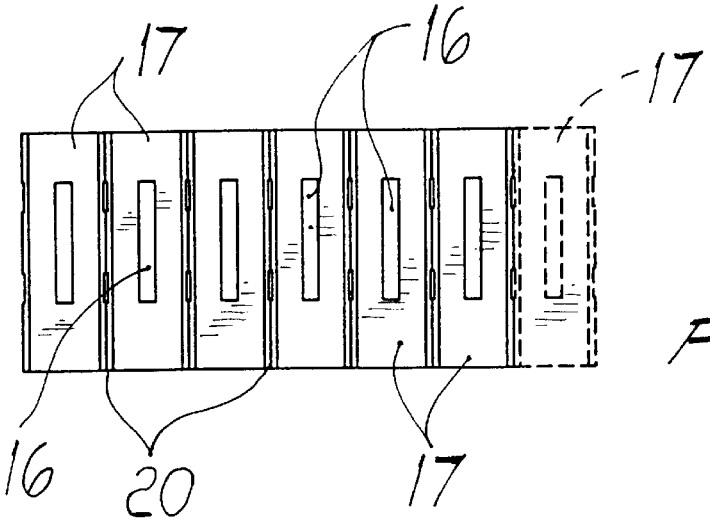
FIGS. 5, 6 and 7 are various partially sectional views of the covers of FIG. 4.
Figure 6:
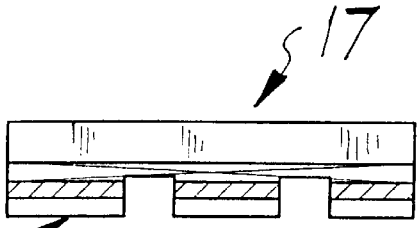
Figure 7:
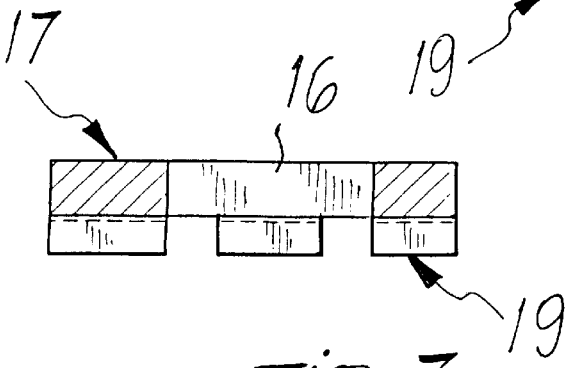

With particular reference to FIGS. 1 to 7, serially associated connectors, particularly for electrical terminals, according to the invention are generally designated by the reference numeral 10.

The series of connectors 10, in this case, is constituted by a plurality of connectors, each of which is designated by the reference numeral 11. Such connectors are monolithically connected to each other by pairs of flexible laminar straps 12 which allow to form reels which can be loaded into wiring machines, not shown.

In particular, in this case, the two mutually opposite straps 12 arranged between two adjacent connectors 11 are arranged at the ends of the connectors, which are in practice arranged transversely to the longitudinal extension of the series 10.

The connectors 11 also have, in this case, a plurality of cavities 13 which are adapted to form seats which accommodate electrical terminals, not shown.

In this embodiment, at each one of partitions 14 that separate two adjacent cavities a laminar tab 15 is provided which is adapted to enter with slight interference a slot 16 formed in a cover 17 for closing the cavities 13.

In this case, a plurality of covers 17 is connected monolithically so as to form a series 18.

In particular, the covers 17 are mutually connected by bridges 19 at their longer sides; each bridge has a groove 20 adapted to form a stress raiser.

In particular, a series 18 of covers 17 can be cut to size in order to adapt to closing various kinds of connector 11.

In this case, a plurality of terminals, not shown, can also be formed monolithically so as to form a continuous series which can be wound into a reel.

In particular, the terminals are formed by blanking and plastic deformation with a spacing which is adapted for the connectors 11 that constitute the series 10.

The terminals can be inserted automatically according to any selected size at the connectors 11 that compose the series 10.

In practice it has been observed that the present invention has achieved the intended aim and objects.

In particular, it should be noted that the serially associated connectors according to the invention can form reels which can be easily used to feed wiring machines.

The monolithic connection in fact ensures the stability of their mutual coupling; however, the coupling can also be easily eliminated during application simply by cutting the connecting straps.

It should also be noted that the serially associated connectors according to the invention can conveniently be combined with series of monolithic covers, which can adapt the application thereof to a wide range of connectors without modifying the molds.

A further integration for facilitating wiring automation arises from the series of terminals, whose spacing is adapted for the corresponding series of connectors.

As a whole, it is noted that the serially associated connectors according to the invention allow ideal and optimum automation in the wiring process, allowing machines meant for this operation to work in a suitable manner.

The present invention is susceptible of numerous modifications and variations, all of which are within the scope of the inventive concept; likewise, the constructive details may be replaced with other technically equivalent elements.

The materials and the dimensions may be any according to requirements.

The disclosures in Italian Utility Model Application No. PD97U000081 from which this application claims priority are incorporated herein by reference.

What is claimed is:

1. A set of serially associated electrical connectors for feeding automated wiring machines, wherein the connectors are monolithically connected to each thereby one or more flexible straps which allow to form reels which can be loaded into wiring machines, each connector having one or more laminar tabs, each of which is adapted to enter with interference, a corresponding slot provided in a cover for closing one or more terminal accommodating cavities.

2. The set according to claim 1, wherein two adjacent connectors are connected by two mutually opposite; straps, said connectors being arranged transversely to the longitudinal extension of said set of connectors.

3. The set according to claim 1, wherein the covers of the connectors are mutually monolithically connected, by bridges provided with a groove which is adapted to form a break inducing region.

* * * * *